US005628502A

United States Patent [19]

Amarakoon

[11] Patent Number: 5,628,502

[45] Date of Patent: May 13, 1997

[54] LOW FORCE SHEET HOLE PUNCHING SYSTEM IN OUTPUT COMPILER OF REPRODUCTION APPARATUS

[75] Inventor: Kiri B. Amarakoon, Pittsford, N.Y.

[73] Assignee: Xerox Corporation, Stamford, Conn.

[21] Appl. No.: 689,297

[22] Filed: Aug. 8, 1996

[51] Int. Cl.[6] ..... B65H 39/05

[52] U.S. Cl. ..... 270/58.07; 399/407; 83/620; 83/167; 83/375

[58] Field of Search ..... 270/58.01, 58.07; 399/407; 83/618, 620, 167, 456, 375

[56] References Cited

U.S. PATENT DOCUMENTS 4,819,021 4/1989 Doery ..... 355/13

4,988,030 1/1991 Muramatu et al. ..... 227/27

*Primary Examiner*—John T. Kwon

[57] ABSTRACT

In a sheet output system with a stacking tray for accumulating, registering, and stacking on top of preceding sheets in a superposed set stack the printed sheets sequentially individually outputted by a reproduction system; a low force sheet hole punching system integral the output stacking tray for punching holes through only one individual sheet at a time on top of the set stack, before the next sequential sheet is so registered and stacked, with all of the sheets having underlying commonly superposed sheet holes which function as a punch die.

5 Claims, 2 Drawing Sheets

Figure 1:
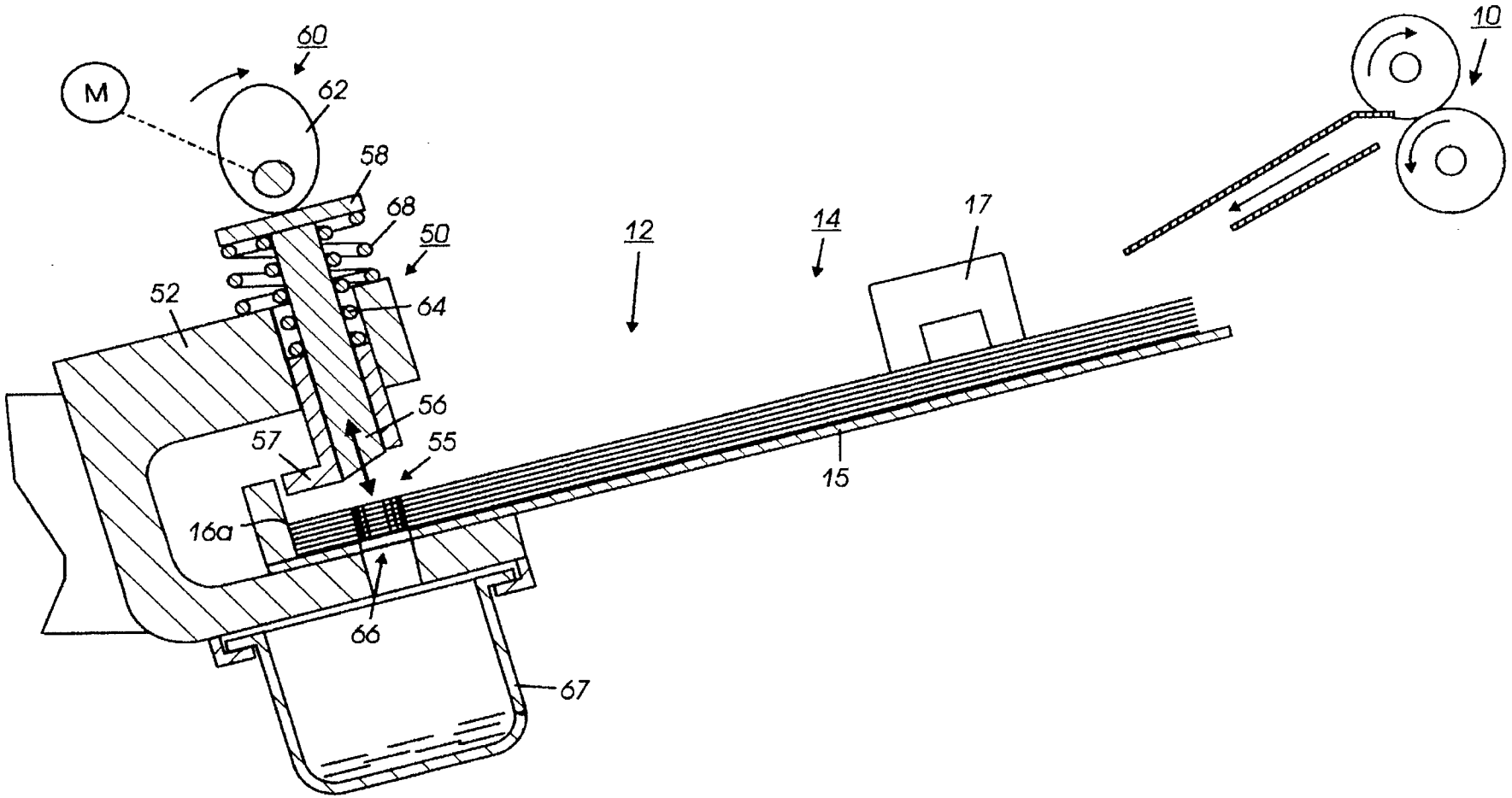

LOW FORCE SHEET HOLE PUNCHING SYSTEM IN OUTPUT COMPILER OF REPRODUCTION APPARATUS

The disclosed embodiment relates to an improved system of on-line selectable hole punching of printed sheets of paper or the like as they are being outputted by a copier or printer, which is simple, low cost, and compact, and can be integrated entirely within an existing compiler/stacker sheet output system for said reproduction apparatus. In this disclosed system, each sheet is individually hole punched, one sheet at a time, as each sheet is outputted and commonly stacked, using the preceding punch holes in the underlying sheets of the stack as a punch dye, thus allowing a much lower punching force for the hole punching as compared to hole punching through an entire set of sheets at once.

Users of copiers, printers, or other reproduction apparatus frequently desire their print jobs to be outputted as sets of printed sheets already prepunched, so that the job sets can be directly or even automatically put into three ring, two ring, or other standard notebooks or binders. Such binders typically require sheets with holes of an appropriate number and spacing from the edge margin of the sheet and from one another.

Commonly, this is now provided by loading prepunched paper stock into the copier or printer and then printing on those prepunched sheets. This has, however, several disadvantages. First, it required pre-ordering, purchasing, stocking and warehousing of such special prepunched paper, so that it is available when such print jobs are needed. Several different weights, sizes, and/or colors of such special use prepunched paper may be required to be stored on hand, with associated inventory and other costs. Secondly, prepunched holes in the sheets can interfere with proper feeding or printing of such sheets; for example, by falsely actuating or triggering lead or trail edge sheet sensors in the sheet feeding path of the printer or copier. Thirdly, since the first or odd page of the print job must have the prepunched holes on the left margin of the sheet, not the right margin, and so forth for subsequent pages, the orientation in which such prepunched sheets are loaded into the copier or printer is critical for proper orientation of the printed image relative to the holes. Such prepunched stock is, of course, not even available for roll or web fed copiers or printers as opposed to pre-cut sheet fed copiers or printers. Nor is it suitable for letterhead or other pre-printed paper stock.

To overcome the above and other disadvantages of prepunched (also referred to as predrilled) paper stock, some copiers have begun to offer on-line hole punching of the sheets during or immediately after the printing process in the copier, so that conventional unpunched blank copy sheet stock may be utilized, yet provide appropriately punched print jobs in the output. Also, it has been suggested in prior patents. Noted, for example, is Xerox Corporation U.S. Pat. No. 4,819,021 issued Apr. 4, 1989 to Michael S. Doery, noting particularly the left-hand sides of FIGS. 3 and 4 and Col. 8 (Attorney Docket No. D/86170). IBM Technical Disclosure Bulletin Vol. 22, No. 8A, January, 1980, pages 3119–3120, discloses a multiple pattern rotary punch of a type previously used for punching rolls of web-like material, for use in in-line copier or offset press oscillatory punching of single copy sheets. The punch device disclosed can be fitted with different arrays of hole patterns, it is also stated. Mead Corporation U.S. Pat. No. 4,575,296 issued Mar. 11, 1986 to Kockler, et al, especially the bottom of Col. 3, and reference No. 40, also suggests on-line hole punching. Also, Canon U.S. Pat. No. 4,763,167 issued Aug. 9, 1988 to T. Watanabe, et al; and Mita U.S. Pat. No. 5,508,799. On-line hole punching of the copier output is believed to have been available in a Konica "7090 RF" product since approximately 1988. Noted is Konica U.S. Pat. No. 4,988,030.

These references also note that on-line hole punching can be provided with or without stapling or other set binding in addition thereto, a feature for which the disclosed embodiments are also compatible.

The disclosed system is usable with a wide variety of sheet output compilers and stackers. Some examples include Xerox Corp. U.S. Pat. Nos. 4,541,626; 4,826,383; 5,044,625; 5,201,517; 5,120,047; 5,014,977; 5,289,251; 5,342,034; 5,261,655; and 5,409,202; and other references cited therein. As will be further described herein, the disclosed embodiment integrally incorporates an on-line hole punching system into a compiler/stacker in a manner which is fully compatible with and may cooperatively utilize the sheet entrainment and movement provided by the compiler/stacker, and other elements thereof. This integrated system enables optional on-line hole punching to be provided in the output sheets without any increase in the overall size of the sheet output system, or any reduction in printing speed. Also, the sheet punching as disclosed herein is desirably at the exposed output-end of the printing system, and therefore is readily accessible for adjustments, repairs, and, most importantly, jam clearances of any sheet jams or removal of sheets during machine stoppages. That is, the hole punching system disclosed herein is not buried internally within the copier or printer in an access-restricted location.

Another advantage of the disclosed integral hole punching and stacking embodiment is that the hole punching is accomplished on-line yet without having to interrupt, even briefly, the sheets printing. Yet, the sheet edge is registered and deskewed before and during hole punching here, which is essential for proper positioning of the punched holes in the sheets and for consistent hole positions in the outputted set. Not only is the edge of the sheet being punched here registered, the existing transverse registration system of the existing compiler/stacker, of, for example, said above-cited patents, may desirably be utilized to provide transverse registration of the sheet prior to its hole punching as well. That is, both of the existing process direction and lateral registration systems provided by the output stacker can provide a dual mode function, in that they can also provide both forward and lateral registration of the sheet for punching of the desired pattern of holes therein in the proper positions therein. Thus, preexisting registration and stacking systems can be used with only minor, low cost, additions or modifications.

As noted, a particular advantage of the disclosed system is that the hole punching force is greatly reduced. Here, only one; sheet at a time is punched, rather than a whole set of sheets.

A specific feature of the specific embodiments disclosed herein is to provide, in a sheet output registering and stacking system with an output stacking tray for accumulating, registering, and stacking on top of preceding sheets in a superposed set stack the printed sheets sequentially individually outputted by a reproduction system, the improvement comprising a low force on-line sheet hole punching system integral said output stacking tray for punching holes through only one said individual sheet at a time on top of said superposed set stack of printed sheets as each said individual sheet is so registered and stacked, and before the next sequential sheet is so registered and stacked, so that all of the preceding sheets of said set stack have underlying commonly superposed holes.

Further specific features disclosed herein, individually or in combination, include those wherein said low force sheet hole punching system has a hole punch normally overlying said superposed set stack of printed sheets in said stacking tray and reciprocally drivable through said individual sheet on top of said superposed set stack of printed sheets and at least partially through said underlying commonly superposed holes of said underlying sheets of said set stack, which superposed holes of said underlying sheets function as a punch die; and wherein said hole punch has a reciprocal punch driving system automatically actuated as each said individual sheet is so registered and stacked, and before the next sequential sheet is so registered and stacked; and/or wherein there is additionally provided a mating punch die provided by an aperture in said stacking tray underlying said superposed set stack of printed sheets and said hole punch for functioning as a punch die for the initial sheets of said set stack; and/or wherein a punch waste paper container is mounted under said aperture in stacking tray; and/or wherein a sheet set clamp is mounted with said hole punch to be driven down with said hole punch by said reciprocal punch driving system until said set clamp forcibly engages said individual sheet against said superposed set stack of printed sheets.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software and computer arts. Alternatively, the disclosed control system or method may be implemented partially or fully in hardware, using standard logic circuits or single chip VLSI designs. Conventional sheet path sensors or switches connected to the controller may be utilized for sensing, counting, and timing the positions of sheets in the sheet paths, and thereby also controlling the operation of sheet feeders and inverters, as well as the hole punch driver, etc., as is well known in the art.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Figure 2:
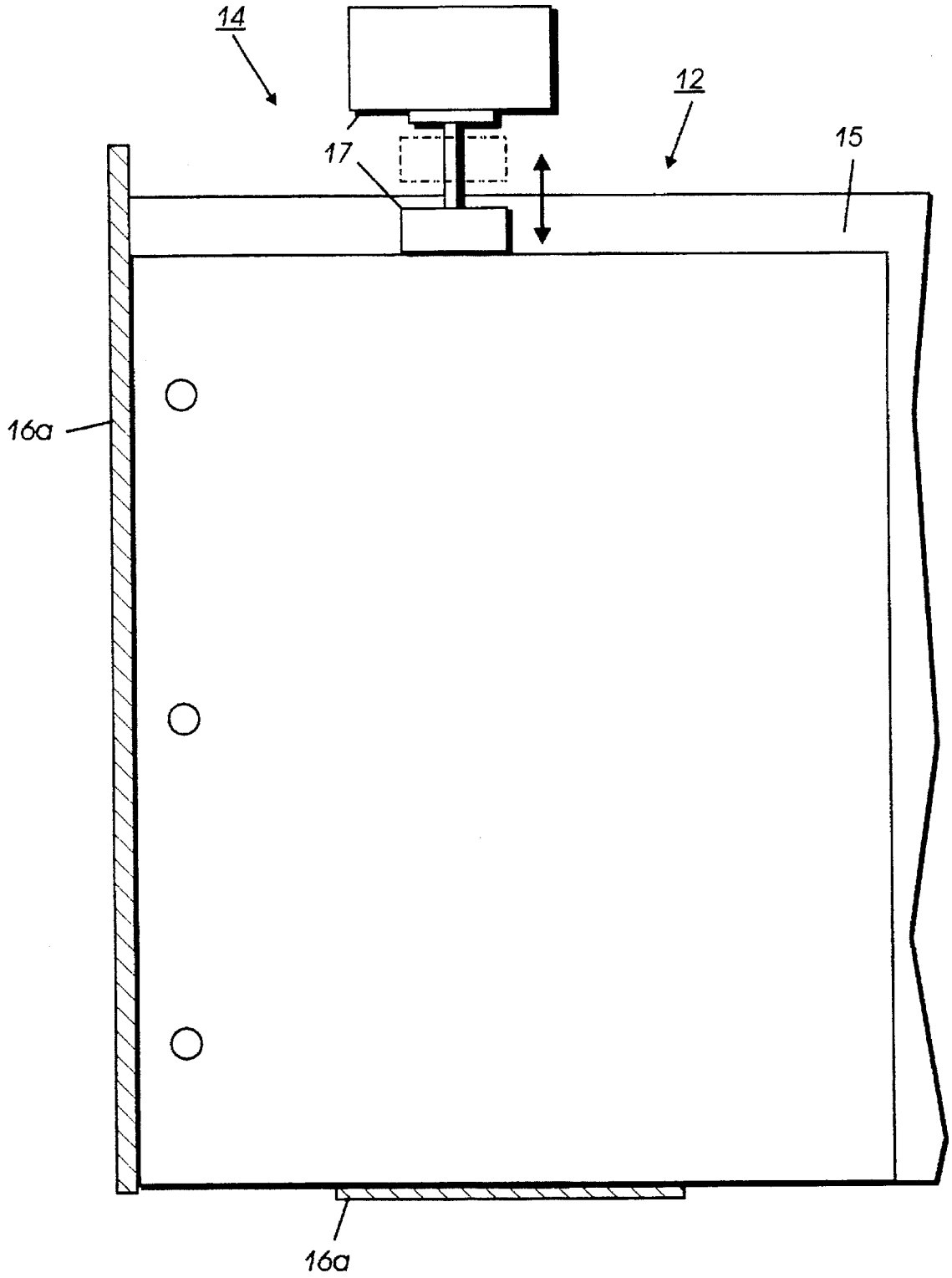

Various of the above-mentioned and further features and advantages will be apparent from the specific apparatus and its operation described in the examples below, and the claims. Thus, the present invention will be better understood from this description of a specific embodiment, including the drawing figures (approximately to scale) wherein:

FIG. 1 is a schematic side view of one example of an integral sheet hole punching and registered sheet stacker output system for the output of a sheet printing system, shown partially in cross-section; and FIG. 2 is a partial top view of the embodiment of FIG. 1, cut away to show an exemplary three hole punched sheet set in the output tray.

Referring to the example shown in the Figures, there is illustrated schematically the output end of an otherwise conventional printing system 10, sequentially feeding its printed sheet output into a connecting finisher module directly associated therewith for on line finishing, exemplified here by a sheet output system 12, including a sheet compiler registration and stacking system 14 having an integral hole punching system 50.

The registration and stacking system 14 in this example, including a stacking tray 15, and registration walls **16*a*, 16*b*, and tamper 17, may be similar to that described in more detail in various of the above-cited U.S. patents, and accordingly said conventional, pre-existing, features need not be described in detail herein except as to the important modifications thereof for the hole punching system 50 to be subsequently described. As in conventional output systems, the outputted printed sheets are fed by exit roller nips into the registration/stacker system 14, until the sheet lead edge and one lateral edge engage respectively the orthogonal registration walls 16*a* and 16*b*, which provide deskewing and sheet edge registration of the incoming sheet, assisted by tamper 17, or other known sheet jogger or top flapper systems. At least one lateral edge of the sheet is engaged by the lateral sheet tamping system 17, which tamps or slides the sheet laterally into wall 16*b*. Thus, the incoming sheet is both forwardly and laterally registered in tray 15, assisted by gravity by the downward slope of tacking tray 15**. It will be appreciated that this is merely one example and that other stacker operations and registration systems are well known.

Turning now to the exemplary hole punching system 50 illustrated in this example, it may be seen that it is fully integrated into the existing registration stacker sheet output system 14. Preferably, three sheet punch assemblies 52 are provided, so as to provide for simultaneous standard two or three hole punching. The punching of the punches can be overlapping or sequential, and punching can be applied by a cam and motor as shown much more gradually than with a solenoid punch, for lower impact and quieter operation. With the punching system disclosed herein, the punching can even be accomplished by a conventional clutch takeoff from an existing sheet drive of the system illustrated by its existing drive motor M.

Although only one hole punch is visible in FIG. 1 of the embodiment, it will be appreciated that, as is conventionally practiced, two or three spaced punches may be provided along the edge of the sheet at the proper margin positions for simultaneously or overlappingly punching two or three punch holes in the sheet. This, of course, reduces the required punching time as compared to moving a single hole punch to a different position along the edge of the sheet for sequentially punching the punch holes in the sheet. The use of plural substantially simultaneously actuated hole punches also allows the present system to be advantageously utilized to provide punched sheet output without requiring any delays or skipped printing cycles in the copier or printer outputting the sheets to be so processed.

It will also be appreciated that all of the punches may be preferably conventionally mounted for lateral position adjustment such as being mounted on slide rails or rods so that the proper position and spacing of the punch hole locations can be reset to the type of binder utilizing the holes, the size of the sheets being punched, the registration position of the sheets being outputted relative to the punches, etc.

The sheet punch assemblies 52 have respective jaws 55 with sheet set acquisition slots for acquiring a lead edge margin of the sheet therein for punching. A cylindrical punch 56 of the standard hole punch diameter is movable down from the upper side of the jaws 55 toward and through the tray 15 bottom. Each hole punch 56 has a conventional tapered sharp edge front face, to punch a round hole in the sheet while the sheet is in the appropriate position. Each punch operates whenever the respective punch head 58 thereof is engaged and driven in by the punch actuating system 60, here an eccentric cam 62 rotated by Motor M. The punch heads 58 can be simple cam followers, or may be engaged by an intermediate force multiplying lever system.

Each sheet punch assembly 52 is preferably mounted independently for lateral repositioning here, such as being laterally slidable along a mounting shaft, to suit the particular customer desired hole punching positions. For two hole punching, two of the punch assemblies may be moved into the desired hole positions thereof, and the third or outboard punch assembly may be moved laterally completely out of the sheet path for that size sheet, so as to be inoperative. Set screws or other detents may be utilized to hold the punch assemblies in their selected lateral positions. They are not subjected to any significant lateral forces. Alternatively, or additionally, the camming system may be removed or disengaged for one or all of the punch assemblies when hole punching is not desired. It will be appreciated that many other alternatives can be provided, especially for the punch actuating system 60.

The hole punches here are not actuated until after the binding edge of the sheet has been fully registered in the output tray preferably with scuffing and/or tamping devices, as described above. This can be conventionally determined simply by a preset time delay after the trail edge of the sheet leaves the sheet path sensor in the output of the copier or printer, or a sheet path sensor in input nip feed rollers of the finishing device or module, which is ejecting the sheet into the stacking tray 15. Note that the stacking tray 15 may desirably be inclined downhill as shown towards the lead edge registration edge to assist in obtaining and maintaining registration with that lead edge registration wall **16*a*. At such a preset time, the motor and/or clutch can actuate the cam 62 to drive down the punch 56**.

Typically, however, a set clamp is first actuated to grip the set to be punched. Here in this example, a top paper clamp 57 is slidably mounted around the punch pin 56 under the punch head 58. Thus, when the punch head 58 is punched down by the cam, a spring 64 first pushes the paper clamp 57 clown onto the top-most sheet at that time in the paper stack in the tray 15 to clamp down that sheet and maintain it in alignment with the previous sheets in the stack throughout the subsequent hole punching process. As the cam 62 continues to rotate in the same direction, the punch pin 56 passes down through the clamp opening 57 and punches a hole in the top sheet of the paper stack, i.e., that sheet which has just been ejected and registered on the stack as described above.

Because this step is repeated for each sheet as it is aligned on top of the stack, the previously stacked sheets will have all accumulated with aligned prepunched holes in the same position. Thus, the paper stack itself serves as the punch die for the punching of the top sheet in each case, except for the very first sheets. For the first few sheets of the stack, an aperture 66 in the tray bottom aligned with the punch 56 provides the punching die for those initial sheets. Directly under this aperture 66 is a removable wastepaper container 67 for the "confetti" waste paper punched out from the holes in the sheets. Note that it is not necessary for the punch to have an operating stroke which always extends all the way through all of the stack, since only the top sheet is being punched at any time. However, for mechanical simplicity, a single stroke cam system such as shown here may be utilized. Since the punching system here overlies the stacking area, it should not cause a catch or obstruction for incoming sheets, even if they have slightly upcurled lead edges. The paper clamp and punch are positioned and configured as shown to provide a smooth sheet entrance into the punch system's opening or jaw.

To ensure that the paper clamp 57 fully lifts out of the path of the next incoming sheet as well as the punch, an additional spring 68 may be provided as shown and the paper clamp may be lifted thereby via the spring 68 (or a stop or catch limiter on the punch pin engaging the paper clamp) as the punch pin lifts.

It will be appreciated that the stacking tray and its registration system should maintain the set in the same position throughout the sequential hole punching of the sheets being sequentially punched as they accumulate and stack therein, as otherwise the respectively punched holes will not maintain a sufficiently accurate alignment, and therefore the punch would not be able to freely pass through the previously punched holes in the underlying sheets, and/or would shave additional paper from the edges of the holes and produce unacceptable oversized or irregular punch holes in the sheet set. This is achievable here since the punching process does not induce any lateral forces on the sheets in the tray, and all the sets are maintained against the two orthogonal registration walls **16*a*, 16*b* throughout the process. This is further ensured by the downward pressure of the clamp 57** holding down the entire set throughout each punching process. That clamping also ensures that the sheet being punched is held flat between the punching position and the edge of the sheet engaging the registration wall, to further ensure that the hole position will not change with sheet curl or as the stack accumulates.

Once the sheet punching has been accomplished, the respective punches 56 may be conventionally retracted back to their initial positions, to reopen the jaws 54 for receiving a subsequent sheet, by springs 64 and 68 under each punch head 58, as shown, or the like. By contouring a gradual retraction of the cam profiles of the punch actuating system 60, this retraction of the punches 56 can be made gradual, and thus further eliminate shock loads or acoustic noise in the system.

After an entire set has been hole punched, it may be conventionally automatically removed or ejected. Optionally, stapling, stitching or binding can be additionally provided before or after such set removal.

While the embodiments disclosed herein are preferred, it will be appreciated from this teaching that various alternatives, modifications, variations or improvements therein may be made by those skilled in the art, which are intended to be encompassed by the following claims:

I claim:

1. In a sheet output registering and stacking system with an output stacking tray for accumulating, registering, and stacking on top of preceding sheets in a superposed set stack the printed sheets sequentially individually outputted by a reproduction system, the improvement comprising:

a low force on-line sheet hole punching system integral said output stacking tray for punching holes through only one said individual sheet at a time on top of said superposed set stack of printed sheets as each said individual sheet is so registered and stacked, and before the next sequential sheet is so registered and stacked, so that all of the preceding sheets of said set stack have underlying commonly superposed holes.

2. The sheet output registering and stacking system of claim 1, wherein said low force sheet hole punching system has a hole punch normally overlying said superposed set stack of printed sheets in said stacking tray and reciprocally drivable through said individual sheet on top of said superposed set stack of printed sheets and at least partially through said underlying commonly superposed holes of said underlying sheets of said set stack, which superposed holes of said underlying sheets function as a punch die; and wherein said hole punch has a reciprocal punch driving system automatically actuated as each said individual sheet is so registered and stacked, and before the next sequential sheet is so registered and stacked.

3. The sheet output registering and stacking system of claim 2, wherein there is additionally provided a mating punch die provided by an aperture in said stacking tray underlying said superposed set stack of printed sheets and said hole punch for functioning as a punch die for the initial sheets of said set stack.

4. The sheet output registering and stacking system of claim 3, wherein a punch waste paper container is mounted under said aperture in stacking tray.

5. The sheet output registering and stacking system of claim 2, wherein a sheet set clamp is mounted with said hole punch to be driven down with said hole punch by said reciprocal punch driving system until said set clamp forcibly engages said individual sheet against said superposed set stack of printed sheets.

* * * * *